United States Patent [19]

Alter

[11] Patent Number: 4,688,789

[45] Date of Patent: Aug. 25, 1987

[54] EXERCISE METHOD

[76] Inventor: Efim Alter, 7533 Horrocks St., 1st Floor, Philadelphia, Pa. 19152

[21] Appl. No.: 808,549

[22] Filed: Dec. 13, 1985

[51] Int. Cl.[4] ..... A63B 1/00; A63B 25/08; A61H 3/02

[52] U.S. Cl. ..... 272/70; 272/114; 135/71

[58] Field of Search ..... 272/70, 70.4, 93, 109, 272/114; 135/68, 71–75, 65, 66, DIG. 11; 623/32, 33

[56] References Cited

U.S. PATENT DOCUMENTS

| | | | |
|---|---|---|---|
| 1,358,643 | 11/1920 | Lamming | 135/72 |
| 1,417,250 | 5/1922 | Kelly | 135/65 |
| 2,197,279 | 4/1940 | Thorssen | 135/71 |
| 2,547,265 | 4/1951 | Hilgeman | 135/73 |
| 2,817,348 | 12/1957 | Holliday | 135/72 |
| 2,861,582 | 11/1958 | Miller | 135/71 |
| 3,730,198 | 5/1973 | Johnston et al. | 135/72 X |

FOREIGN PATENT DOCUMENTS

| | | | |
|---|---|---|---|
| 563647 | 9/1923 | France | 135/71 |
| 1164800 | 5/1958 | France | 135/68 |

*Primary Examiner*—Richard J. Apley
*Assistant Examiner*—S. R. Crow
*Attorney, Agent, or Firm*—William H. Eilberg

[57] ABSTRACT

A method of exercise is disclosed which enables the user to exercise both the arms and the legs simultaneously. The method utilizes a device which includes a pair of arm braces having handles which can be gripped by the user. The arm braces have supports which rest on the ground. The length of the support is chosen such that the sum of the distance from the handle to the distal end of the support, plus the length of the arm of the user, is equal to the length of the user's leg, including the thigh. The arm braces, in effect, form extensions of the user's arms, and make the length of the arms equal to the length of the legs. With the aid of the device, the user can walk or run on all fours, without squatting or bending the knees appreciably, thereby exercising the arms and the legs at once.

3 Claims, 3 Drawing Figures

EXERCISE METHOD

BACKGROUND OF THE INVENTION

The present invention relates to the field of exercise devices, and discloses a method of exercise which enables the user to exerise both the arms and the legs simultaneously.

Most exercises and exercise devices available today are designed to exercises either the arms or the legs, but not both at the same time. For example, the sport of jogging is very popular, as it provides an aerobic exercise which strengthens the circulatory system, as well as the muscles in the legs. But the sport provides little or no benefit for the muscles in the arms. Various weight lifting devices help to strengthen the muscles in the arms or the legs, but usually not both the arms and the legs.

Other exercises, such as swimming, which do provide exercise for the arms as well as the legs, require relatively expensive equipment, such as swimming pools, which is normally not transportable.

Moreover, some of the exercises which are popular today can be stressful or even harmful to the back. Indeed, it is believed that human beings are anatomically designed for walking on all fours, and that the evolution to bipedal locomotion created stresses to which humans have not completely adapted.

The present invention therefore discloses a method of exercise which provides aerobic exercise, and which enables both the arms and the legs to receive approximately equal degrees of exercise. Furthermore, the method of exercise provides an exercise which is performed in a more "natural" position, in an evolutionary sense, and which is less inclined to harm the back of the individual.

SUMMARY OF THE INVENTION

The present method of exercise utilizes a pair of arm braces which act as extensions of the user's arms. The user can thereby walk or run on all fours, without the inconvenience and discomfort of squatting.

In the preferred embodiment, the arm brace comprises a U-shaped member which is attached to a vertical support member. The support member is designed to make contact with the ground, and the U-shaped member is equipped with a handle which can be gripped by the user. A security ring is attached to the proximal end of the arm brace, the ring being of sufficient diameter to allow the user's arm to be inserted through the ring. The diameter of the ring, however, is small enough to provide meaningful bracing action. The pressure of the ring against the user's arm holds the arm brace in the upright position even while the user is walking or running briskly on all fours.

The lengths of the support member and the U-shaped member are chosen such that the arm brace almost exactly compensates for the difference in length between the arm and the leg. More precisely, the lengths are chosen such that the sum of the distance from the handle to the ground, plus the length of the user's arm, is equal to the length of the user's leg, including the thigh. Therefore, the user can walk or run on all fours without bending the knees appreciably.

It is therefore an object of the present invention to provide an exercise method which enables the arms and the legs to be exercised simultaneously.

It is another object of the invention to provide an exercise method as described above, wherein the method enables the user to walk or run on all fours without squatting or bending the knees to any significant degree.

It is another object of the invention to provide a method of exercise for providing aerobic exercise.

It is another object of the invention to provide an exercise method which does not cause stress to the back.

It is another object of the invention to provide an exercise method which can be easily practiced virtually anywhere, and which requires no expensive equipment to use.

Other objects and advantages of the invention will be apparent to those skilled in the art, from a reading of the following brief description of the drawings, the detailed description of the invention, and the appended claims.

DETAILED DESCRIPTION OF THE INVENTION

The present invention comprises a pair of substantially identical arm braces which act as extensions of the user's arms. When the arms are effectively increased in length so that they reach the ground, the user can walk or run on all fours without squatting, and without the need to bend the knees appreciably.

Figure 1:
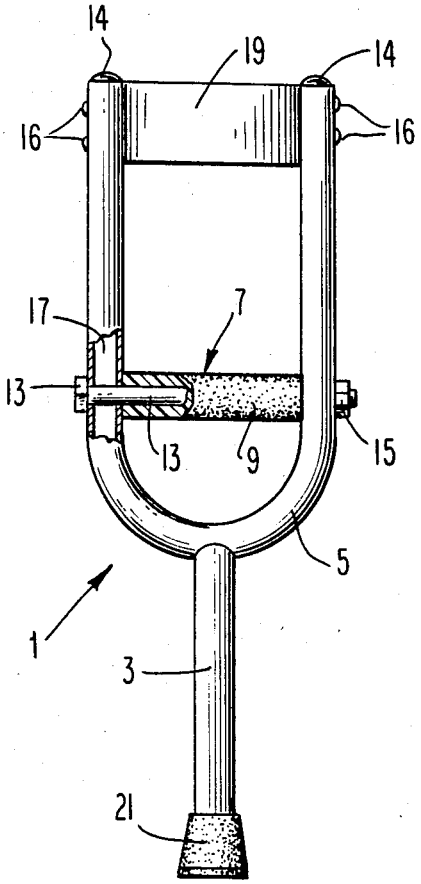
FIG. 1 is an elevational view of one of the arm braces constructed according to the present invention.

One of the arm braces described above is shown in FIG. 1. The arm brace, which is designated generally by reference numeral 1, includes support member 3 and U-shaped member 5. U-shaped member 5 is preferably constructed of metal, and may be a hollow tube having interior region 17, as shown.

Handle 7 is attached to the U-shaped member. The handle is supported by bolt 13, which is preferably encased in a cushioned material 9, such as rubber. Bolt 13 is secured to the U-shaped member by nut 15.

The bottom end of the arm brace is provided with end piece 21, which can be made of rubber or similar material. This end of the arm brace is also called the "distal" end, because it is the most distant point on the arm brace from the user. The other end of the arm brace, i.e. the end which is closest to the user, is called the proximal end.

Plastic caps 14 are used to seal the open ends of U-shaped member 5. U-shaped member 5 can be made of solid material, if desired, in which case the caps 14 would be omitted.

Figure 2:
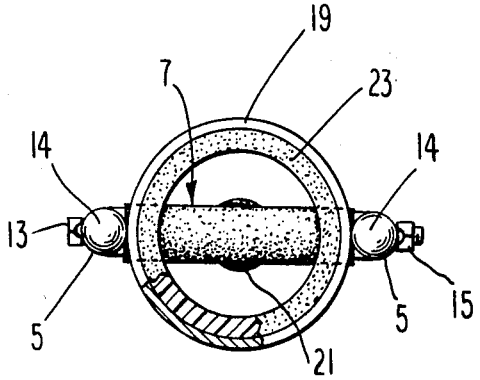
FIG. 2 is a top view of the arm brace shown in FIG. 1, partly broken away to show the metal of the security ring of the arm brace.

A security ring 19 is mounted on the arm brace 1, at its proximal end. The security ring 19 is attached to U-shaped member 5 by bolts or rivets 16. The structure of security ring 19 is more clearly shown in FIG. 2. Security ring 19 is preferably made of metal, or of another rigid material, and is provided with a cushioned interior lining 23. The cushioned material 9 of the handle 7 is also visible in FIG. 2. Material 9 and material 23 can be the same material, or can be made of different substances.

Figure 3:
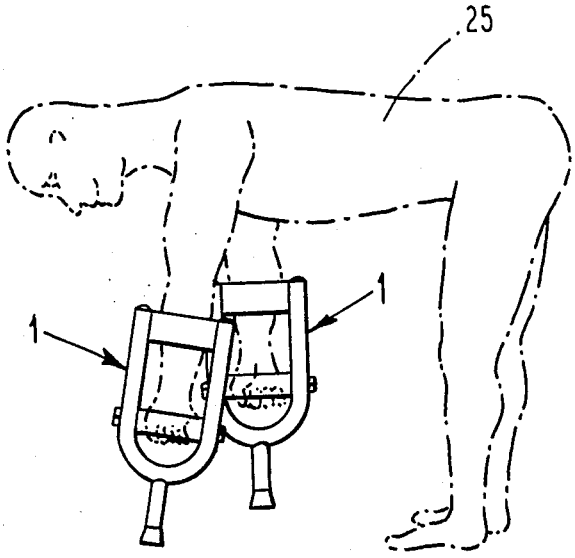
FIG. 3 is a perspective view showing a user exercising with a pair of arm braces of the type shown in FIG. 1.

The user's arm is inserted through the security ring 19, as shown in FIG. 3, which illustrates a user 25 exercising with arm braces 1. The diameter of security ring 19 must be large enough to allow the user's arm to fit through the ring, but not so large that the ring cannot properly brace the arm. If the fit between the ring and the arm is reasonably snug, the arm brace will remain substantially straight even when the user is walking or running briskly on all fours.

The cushioned material 23 thus serves two purposes. It makes the security ring more comfortable, by preventing the user's arm from rubbing directly against the metal ring. And it also serves to narrow the inside diameter of the ring so that the ring will be sufficiently snug, as described above.

As is apparent from FIG. 3, the length of the arm brace is chosen such that the arm brace almost exactly compensates for the difference in length between the arms and legs of the user. In other words, the sum of the distance from the handle to the distal end of the arm brace, plus the length of the user's arm, should be approximately equal to the length of the user's leg, including the thigh.

To provide optimum stability during use, the overall length of the arm brace should be less than the length of the arm of the user, as shown in FIG. 3. Also, the distance between the handle of the arm brace and its distal end should be less than the distance between the knee and foot of the user.

The hollow portions 17 of the arm braces can be filled with lead pellets, or other substances, to increase the weight of the device, and thereby to provide a more rigorous exercise. Alternatively, the device can be used with hollow tubes.

It is clear that the invention can be easily and inexpensively built. It is also readily transportable, as it does not occupy a significant amount of space. There is no expensive equipment required for its use. It can be used outdoors or indoors, wherever there is space within which to walk. As long as the device is constructed according to the distance relationships given above, the device will enable the user to walk or run on all fours without squatting or bending the knees appreciably.

While the invention has been described with respect to a particular embodiment, it is understood that the invention can be modified in various ways. The shape and material of the U-shaped member and support member can be changed considerably. The support member, or even the U-shaped member, could be made adjustable in length to fit the anatomy of a variety of different users. The material used for the cushions can be varied, or it is even possible to eliminate all cushioning, relying entirely on hard surfaces. The position and width of the security ring can also be modified. For example, the security ring can be placed somewhat lower along the U-shaped member, if desired. These and other modifications are to be deemed within the spirit and scope of the following claims.

What is claimed is:

1. A method of exercising, the method to be practiced by a human user, comprising the steps of:

(a) choosing a pair of arm braces to fit the user, both arm braces having a generally U-shaped member and a support member, the support member comprising a substantially straight rod having a distal end and a proximal end, the distal end of the support member being adapted to rest on the ground, the proximal end of the support member being affixed to the U-shaped member, the arm brace having handle means, connected to the U-shaped member, the handle means being adapted to be gripped by a user of the exercise device, both arm braces being chosen such that the lengths of the support member and the U-shaped member are such that the sum of the distance from the handle means to the distal end of the support member, plus the length of the arm of the user, is substantially equal to the length of the leg of the user, (b) gripping the handle means of both arm braces, while bending over so that the distal ends of the arm braces can touch the ground, and (c) running or walking on hands and legs by using the arm braces as forelegs.

2. The method of claim 1, wherein the length of the arm braces is selected to be less than the length of the arm of the user.

3. The method of claim 1, wherein the distance between the handle means and the distal end of the support means is less than the distance between the knee and the foot of the user.

* * * * *